US005373955A

United States Patent [19]

Marino

[11] Patent Number: 5,373,955

[45] Date of Patent: Dec. 20, 1994

[54] NECK FINISH FOR A WIDE MOUTH CONTAINER

[75] Inventor: Michael Marino, New Castle, Pa.

[73] Assignee: West Penn Plastics, Inc., New Castle, Pa.

[21] Appl. No.: 134,624

[22] Filed: Oct. 12, 1993

[51] Int. Cl.[5] ..... B65D 41/46

[52] U.S. Cl. ..... 215/256; 215/253; 215/31; 220/276; 220/306

[58] Field of Search ..... 215/256, 253, 321, 31; 220/276, 306, 355

[56] References Cited

U.S. PATENT DOCUMENTS

| | | | |
|---|---|---|---|
| 3,940,004 | 2/1976 | Faulstich . | |
| 4,162,736 | 7/1979 | Faulstich | 215/256 |
| 4,166,552 | 9/1979 | Faulstich | 215/256 |
| 4,438,857 | 3/1984 | Bullock, III . | |
| 4,484,687 | 11/1984 | Bullock, III | 215/256 |
| 4,593,830 | 6/1986 | Bullock | 215/256 |
| 4,625,876 | 12/1986 | Bullock, III . | |
| 4,676,389 | 6/1987 | Bullock | 215/232 |
| 4,699,287 | 10/1987 | Bullock | 215/256 |
| 4,815,620 | 3/1989 | Bullock, III | 215/256 |
| 4,844,268 | 7/1989 | Bullock, III | 215/256 |
| 4,903,849 | 2/1990 | Wallman | 215/256 |
| 4,966,292 | 10/1990 | Marino | 215/256 |
| 5,050,754 | 9/1991 | Marino | 215/256 |

*Primary Examiner*—Gary E. Elkins
*Assistant Examiner*—Vanessa Caretto
*Attorney, Agent, or Firm*—Harpman & Harpman

[57] ABSTRACT

A neck finish on a wide mouth container to accept a tamper evident cap to provide multiple sealing surfaces therebetween. The neck finish having cooperating upper and lower locking ribs and grooves holding the cap in place until a majority portion of the cap is removed by tearing along a horizontal frangible line, disengaging one of the locking ribs from the neck finish. The neck finish provides multiple sealing surfaces in both vertical and horizontal alignment.

9 Claims, 1 Drawing Sheet

NECK FINISH FOR A WIDE MOUTH CONTAINER

BACKGROUND OF THE INVENTION

1. Technical Field

This invention relates to so-called wide mouth containers and associated neck finishes that accept tamper resistant closures.

2. Description of Prior Art

Prior art devices of this type have relied on a number of cap and neck finish combinations, see for example U.S. Pat. Nos. 3,940,004, 4,438,857, 4,625,876 and 4,691,834.

In each of the above referred to patents, caps of plastic material are shown with cooperative neck finishes. The present invention provides a wide mouth neck finish that will accept tamper resistant snap cap twist off cap configurations that are provided with a tear tab that must be released and partially removed to allow the cap to be removed from the neck finish.

SUMMARY OF THE INVENTION

A neck finish on wide mouth containers for tamper resistant closures. The neck finish provides multiple sealing configurations for engagement with the closure holding same on the container. The neck finish has an upper portion of a reduced diameter in which vertically aligned ribs and grooves are formed on its outer surface for communication and registration with a tamper resistant cap.

DESCRIPTION OF THE PREFERRED EMBODIMENT

Figure 3:
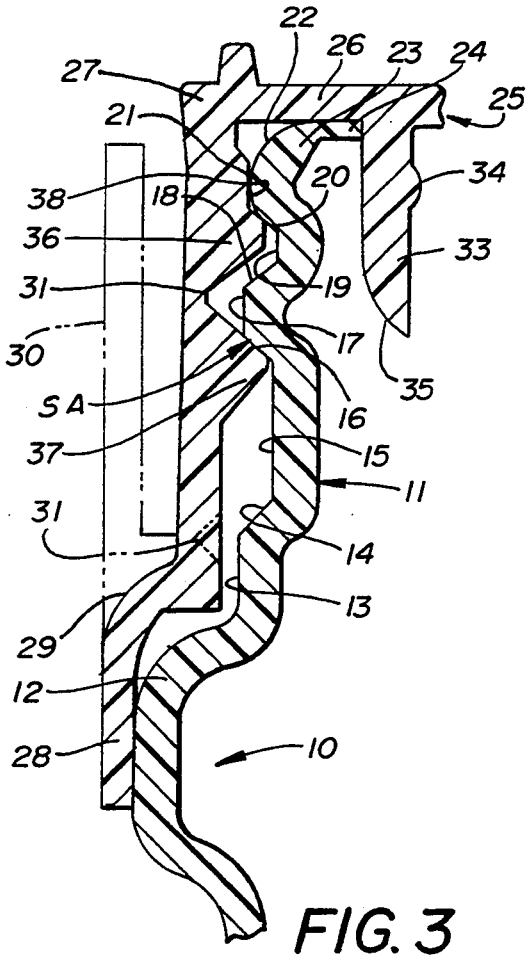
FIG. 3 is an enlarged vertical section of the neck finish of the invention with a portion of the cap of FIG. 1 on lines 3—3 thereof.
Figure 4:
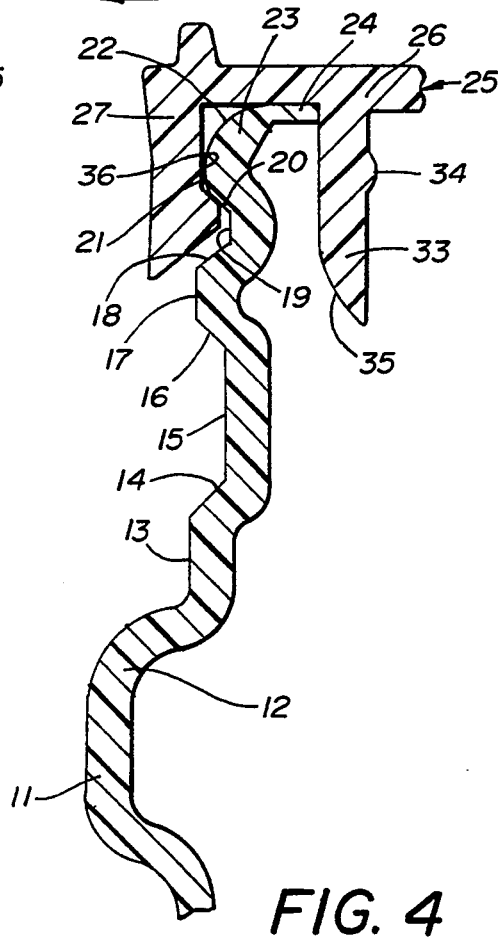
FIG. 4 is an enlarged vertical section of the portion of the cap in FIG. 2 on lines 4—4 thereof positioned on a portion of the neck finish of the invention.

By referring to FIGS. 3 and 4 of the drawings, it will be seen that a container 10 such as a blow molded polyethylene or the like plastic resin material bottle is partially illustrated with a neck finish 11 formed on a cylindrical upper end with an outer surface including an upwardly and inwardly curving section 12 with a first vertical smooth surface 13 extending thereabove. An inwardly and upwardly angled section 14 extends above said first vertical smooth surface 13. A second vertical smooth surface 15 extends inwardly thereabove, an outwardly and upwardly extending angled section 16 defines a primary sealing area. A third vertical smooth surface 17 ascends above the angled section 16 on a vertical plane with said first vertical smooth surface 13. A second inwardly and upwardly angled section 18 extends above said third vertical smooth surface 17 and is angularly inclined towards the horizontal to a greater extent than said first inwardly and upwardly angled section 14, a fourth vertical smooth surface 19 extends thereabove in the same vertical plane as the second vertical smooth surface 15 hereinbefore described. An outwardly and upwardly extending angled section 20 extends thereabove to a fifth vertical smooth surface 21 in the same vertical plane as said third vertical smooth surface 17. The fifth vertical smooth surface 21 transcends into a convex inwardly curving outer surface 22 which continues into a horizontal extending flange 23 of transverse reduced diameter at 24.

Figure 1:
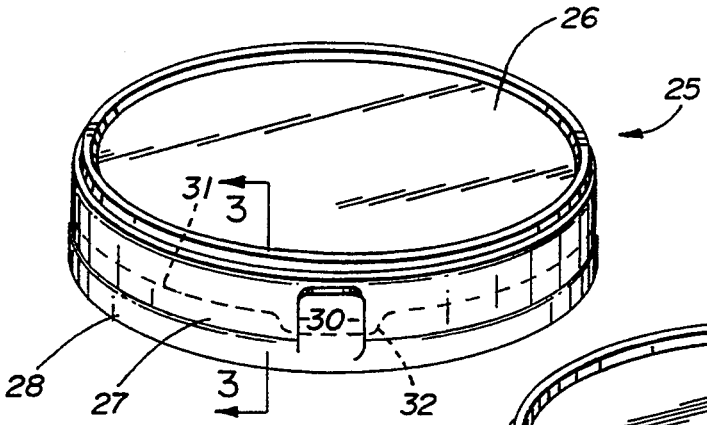
FIG. 1 is a perspective elevation of a cap in use with the present invention.
Figure 2:
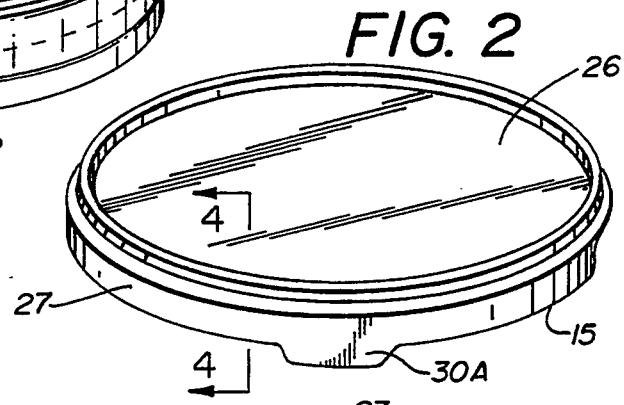
FIG. 2 is a perspective elevation of the cap after removal of the tear skirt.

By referring to FIGS. 1–3 of the drawings, a cap 25 can be seen having a top portion 26 with a depending annular flange 27 extending from the peripheral edge thereof. An annularly outwardly offset secondary flange 28 extends from the lower portion of the annular flange 27, the Junction below an upper portion of the annular flange 27 and the secondary flange 28 comprising an outwardly and downwardly curving section 29.

An upstanding pull tab 30 can be seen in broken lines in FIG. 3 of the drawings and is integrally formed with the secondary annular flange 28 as to extend upwardly from the outwardly and downwardly curving section 29 thereof.

Referring now to FIG. 1, it will be seen that a horizontal frangible tear line 31 extends circumferentially around the depending annular flange 27 substantially above the outward and downward curving section 29 from which the secondary flange 28 depends with the exception that in the area of the depending annular flange 28 adjacent the upstanding pull tab 30. The frangible tear line 31 takes a lower position adjacent the pull tab 30 as best seen in FIG. 2 of the drawings to define a downturned secondary tab 30A. A curving frangible line 32 extends from the second end of the horizontal frangible line 31 adjacent the pull tab 30 to the lowermost edge of the annular flange 27.

It will be evident from the above description that by grasping the pull tab and moving it outwardly from the depending annular flange 27 will tear the portion of the depending annular flange 28 below the horizontal frangible tear line 31 including the secondary flange 28 from the cap 25 along the upper portion of the cap as seen in FIGS. 2 and 4 of the drawings.

The remaining portion of the cap, best seen in FIGS. 2 and 4 of the drawings is comprised of the top 26, the upper portion of the annular depending flange 27 thereon extending downwardly and the secondary tab 30A formed by the removal of the pull tab 30 with the lower portion of the secondary annular flange 28.

Referring now to FIG. 3 of the drawings, it will be seen that when the cap 25 is engaged on the neck finish 11 of the invention, that the uppermost part of the horizontally disposed inturned flange 23 is in sealing relation with the lower surface of the top portion 26 of the cap 25 with the innermost surface of the area of reduced transverse dimension at 24 abutting a depending annular sealing flange 33 which is spaced inwardly in relation to the depending annular flange 27 of the cap 25. An inturned annular rib 34 is formed on the inner surface of the annular sealing flange 33 for increased rigidity, with the lower outer surface 35 of the annular sealing flange 33 curved inwardly and downwardly to position and engage the cap 25 on the neck finish 11 of the container 10.

Still referring to FIG. 3, it will be seen that a pair of annular ribs 36 and 37 are formed on the inner surface of the depending annular flange 27 in vertically spaced relation to one another forming upper secondary sealing and lower primary sealing fastening configurations on the cap 25 and are in abutting sealing relationship to the outwardly and upwardly extending angled sections 20 and 16 respectively of the neck 11.

The fifth smooth vertical surface 21 of the neck 11 is in abutting relationship with a registering vertical smooth surface 38 formed on the inner surface of the annular depending flange 27 thereabove said annular rib 36. A continuous annular seal is thus formed between the respective vertical smooth surfaces 21 and 38 and the respective angular surface section 20 and the upper angular surface of the annular rib 36 as hereinbefore described. Given the foregoing arrangement, it will be seen that the frangible tear line 31 is positioned between said annular ribs 36 and 37 of the depending annular flange 27 as clearly indicated in FIG. 3 of the drawings and adjacent the lower portion of the secondary offset flange 28 indicating its relative position between the upper portion of the annular depending flange 27 and the lower secondary annular flange 28 in the area of the pull tab 30 as hereinbefore described.

It will occur to those skilled in the art that when the pull tab 30 is grasped and used to tear the tear skirt from the original cap structure 25, the remaining cap portions seen in FIGS. 2 and 4 of the drawings still retains two fastening and sealing configurations comprising the hereinbefore described upper portion of the annular depending flange 27 with registering fifth vertical smooth surface 21 of the neck 11 and the respective upper angular surface of the rib 36 in the outwardly and upwardly extending angle section 20.

It will thus be seen that a new and novel neck finish on a wide mouth container for use with a snap on twist off tamper indicating cap has been illustrated and described and it will be apparent to those skilled in the art that various changes and modifications may be made therein without departing from the spirit of the invention, therefore

I claim:

1. A neck finish and tamper indicating cap for a wide mouth container, said neck finish comprising a container neck having a cap receiving finish, said cap receiving finish formed with a cylindrical upper end having a first inwardly curving outer surface and a lower end having an upwardly and inwardly curving section, a first vertical smooth surface immediately thereabove, a first inwardly and upwardly angled surface thereabove, a second vertical smooth surface immediately thereabove, a first outwardly and upwardly angled outer surface immediately above said second vertical smooth surface, a third vertical smooth surface immediately above; a second inwardly and upwardly angled surface immediately above said third vertical smooth surface, a first annular groove in said outer surface formed by said first inwardly and upwardly angled surface and said first outwardly and upwardly angled outer surface, with said second vertical smooth surface therebetween, a fourth vertical smooth surface immediately above said second inwardly and upwardly angled surface, a second outwardly and upwardly angled surface immediately below said cylindrical upper end inwardly curving outer surface, a second annular groove in said cap receiving finish outer surface defined by said second inwardly and upwardly angled surface and said second outwardly and upwardly angled surface and said fourth vertical smooth surface therebetween.

2. The neck finish for a wide mouth container of claim 1 wherein said first annular groove in said cap receiving neck finish outer surface is of a known transverse width, said second annular groove in said neck finish is of a transverse width less than the known transverse width of said first angular groove in said outer surface of said cap receiving finish.

3. The neck finish for a wide mouth container of claim 1 wherein said first outwardly and upwardly angled outer surface is a primary seal for said tamper indicating cap positioned on said neck finish.

4. The neck finish of claim 1 wherein said second outwardly and upwardly angled surface in said outer surface of said neck finish is a secondary seal for said tamper indicating cap.

5. The neck finish of claim 1 wherein said first inwardly curving outer surface has an area of reduced transverse dimension for sealing engagement with said tamper indicating cap.

6. The neck finish of claim 1 wherein said respective second and fourth vertical smooth surfaces therein are in the same vertical plane, and said first and third vertical smooth surfaces of said neck finish are in the same vertical plane.

7. The neck finish of claim 6 wherein said respective second and fourth vertical smooth surfaces and said first and third vertical smooth surfaces are in horizontally spaced parallel vertical planar alignment.

8. The neck finish of claim 1 wherein said first annular groove in said outer surface and said second annular groove in said outer surface are in vertical spaced aligned relation to one another.

9. The neck finish of claim 1 wherein said cylindrical upper end of said neck finish inwardly curving outer surface defines an outer horizontal cap sealing surface and an outer vertical cap sealing surface extending from its respective curving terminal portions.

* * * * *